United States Patent [19]

Gibson

[11] 4,015,852

[45] Apr. 5, 1977

[54] MAZE-TYPE PUZZLE

[76] Inventor: Ross E. Gibson, 1168 W. Cliff Drive, Santa Cruz, Calif. 95060

[22] Filed: May 12, 1976

[21] Appl. No.: 685,767

[52] U.S. Cl. ..... 273/153 R; 273/159

[51] Int. Cl.[2] ..... A63F 9/08

[58] Field of Search ..... 273/153 R, 159

[56] References Cited

UNITED STATES PATENTS

| | | | |
|---|---|---|---|
| 640,555 | 1/1900 | Fuller | 273/159 UX |
| 658,083 | 9/1900 | Favour | 273/153 R UX |
| 694,038 | 2/1902 | Stubbs | 273/159 |

*Primary Examiner*—Anton O. Oechsle
*Attorney, Agent, or Firm*—Joel Halpern

[57] ABSTRACT

A puzzle includes a game board which is subdivided into a plurality of pre-designated areas. Each of the areas is bounded by an upstanding wall in which there is at least one opening. A plurality of string-like elements are connected at one end to first connecting means located in one of the areas and are adapted at the other ends to be detachably connected to respective ones of a plurality of second connecting means located separately in selected other areas.

6 Claims, 4 Drawing Figures

MAZE-TYPE PUZZLE

BACKGROUND OF THE INVENTION

The present invention relates to puzzles of the maze-type and more particularly to a maze-type puzzle which includes a game board and string-like elements secured to the game board.

Maze-type puzzles have been known heretofore. However, the puzzle of the present invention is unique in that it capitalizes upon recent current events which have become familiar to young and old alike and, therefore, imparts to the puzzle an element of familiarity which should enhance its popularity. It has been necessary, however, to devise a special game board which is used cooperatively with a series of string-like elements.

Thus, the recent wire-tapping or "bugging" episodes involving the White House in Washington, D.C. has led to the game apparatus of the present invention which provides for the "bugging" of the Pentagon.

SUMMARY OF THE INVENTION

It is one object of the invention to provide a maze-type puzzle which is entertaining and possesses unique current event interest.

It is another object of the invention to provide a maze-type puzzle which requires a degree of mental ingenuity.

Other objects and advantages of the invention will become more readily apparent from the following description of the invention.

According to the present invention there is provided a puzzle comprising:

a game board having a plurality of predesignated areas on the playing surface thereof;

upstanding walls defining the perimetral boundaries of the areas;

at least one opening in the wall defining each of the areas;

a plurality of first connecting means in one of the areas adapted to have a plurality of string-like elements secured adjacent one end thereof respectively to corresponding ones of the connecting means;

a plurality of second connecting means located separately in preselected other of the designated areas adapted to be detachably connected with the other ends of the string-like elements; and a plurality of string-like elements each adapted to be secured adjacent one end thereof to respective ones of the first connecting means and at the other end with respective ones of the second connecting means.

BRIEF DESCRIPTION OF THE DRAWINGS

In order that the invention may be more fully comprehended it will now be described, by way of example, with reference to the accompanying drawings in which.

DETAILED DESCRIPTION OF THE INVENTION

Figure 1:
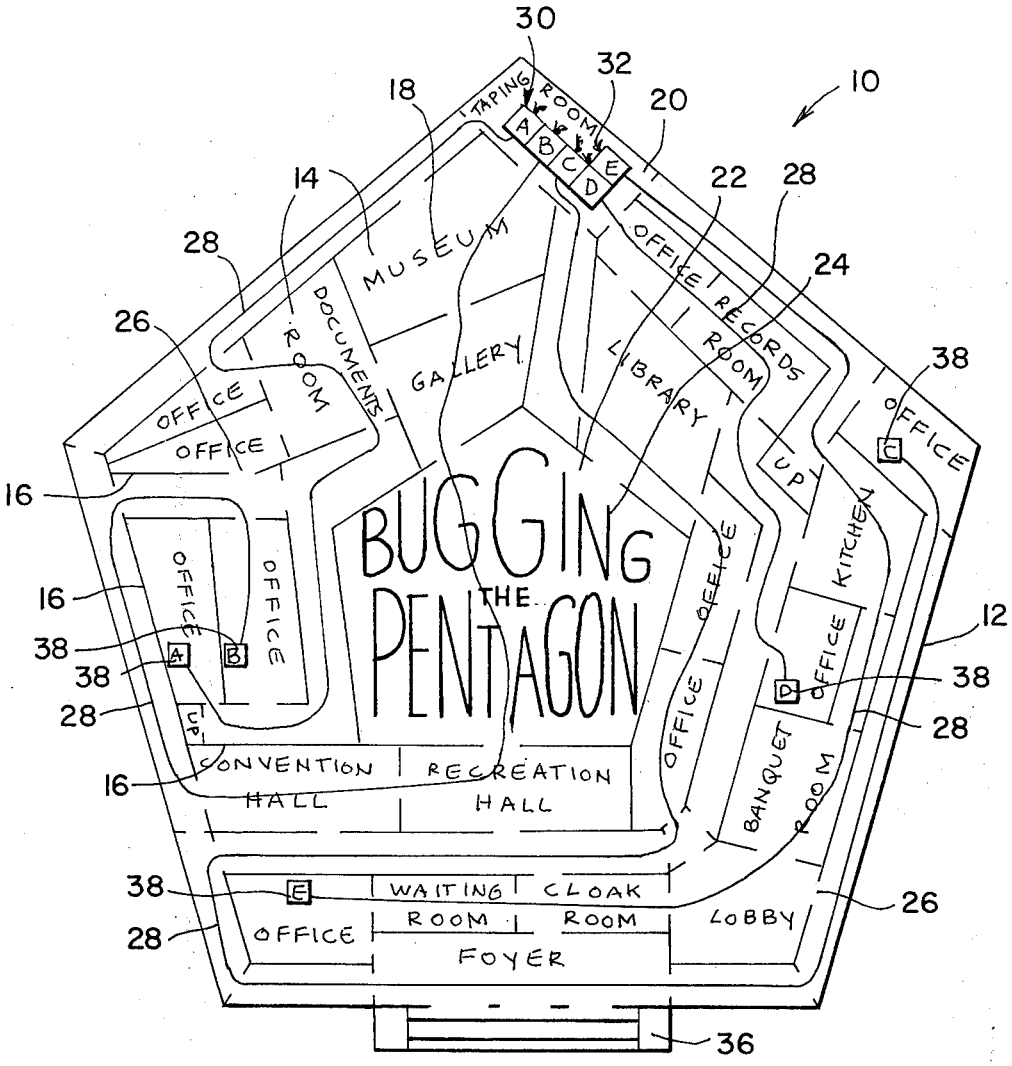
FIG. 1 is a top plan view of the game board of the invention with the string-like elements positioned along paths which represent one solution to the puzzle.
Figure 2:
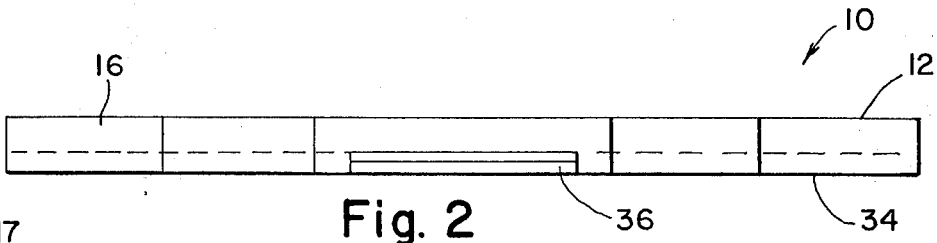
FIG. 2 is a front elevational view of the game board.
Figure 3:
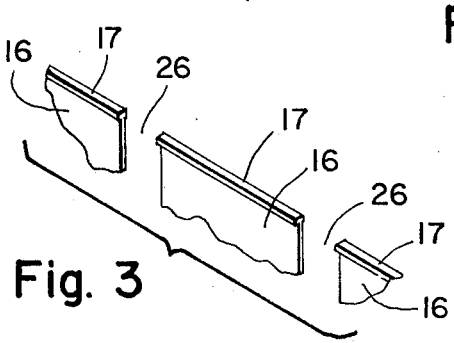
FIG. 3 is a fragmentary perspective view of a segment of the wall structure of the game board shown in FIG. 1.
Figure 4:
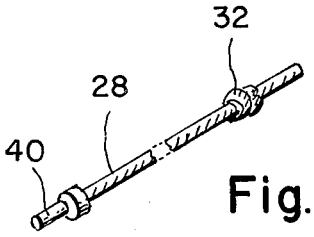
FIG. 4 is a perspective view of a string-like element which can be employed with the game board of FIG. 1.

Referring to the drawings there is shown generally by reference numeral 10, a puzzle. The puzzle desirably takes the form of a pentagonal game board 12 to resemble in plan view the Washington, D.C. military headquarters popularly known as the Pentagon. The game board is subdivided, on its playing surface, into a plurality of predesignated areas 14. Such areas are defined by a series of upstanding walls 16 which rise from the surface of the board along the perimetral boundaries of the areas. Desirably the top of the walls is given an overhanging ledge 17 which serves to retain the string-like element to be hereinafter described in position. Each of the areas may be labeled with suitable indicia 18 to identify particular rooms of the structure. Thus, one of the rooms 20 may be identified as a taping room, several areas may be identified as offices, conference rooms and the like. A central pentagonal courtyard 22 preferably bears indicia 24 identifying the game such as "Bugging the Pentagon." Each of the areas on the game board defined by walls 16 preferably has at least one access opening 26 through the wall configured to resemble a doorway. In this manner all of the rooms or areas of the board are interconnected.

In one of the areas of the game board, desirably in an area 20 at one of the apices of the board, there is provided an arrangement for securing one end of each of a group of string-like elements 28. Such arrangement, for example, may simply comprise several boxes 30 delineated on the game board to represent tape recorders with an opening, preferably square, in each of the boxes to permit the drawing therethrough of one of the string-like elements. The string-like element may be provided with a knot 32 or other detent means thereon to prevent the complete drawing of the element through the opening. Alternatively, the end of the string is inserted into a dowel which is hollow and gives an outer configuration and dimension complementary to that of the opening so that it can be positioned removably within the opening of the board. Desirably the game board includes a base element 34 which has a forwardly extending projection 36 formed to represent a set of steps simulating the entrance to the structure. The base is preferably hollow in the region beneath the taping room, i.e., the area where the tape recorders are located, in order to facilitate insertion of string-like elements 28 through the openings in the tape recorders so that they are secured in place beneath the game board. Where the dowels are provided they may optionally extend through the surface of the board into the hollow space therebelow.

A "bug" or Microphone 38 is located in each of several areas of the game board removed from the taping room and spaced from each other. Each of such "bugs" should be adapted to detachably receive the other end of one of the string-like elements. The "bug" may thus take the form of a socket or an opening in the board, preferably round, which is cooperable with a peg or plug element 40 on the string-like element. Alternatively, the cooperable connecting elements of the "bugs" and string-like elements may both be magnetic. It will be understood, however, that any suitable cooperable connecting elements may be employed on the "bugs" and string-like elements. It will be understood that the outer configuration of the plug element 40 should be different than that of the dowel employed so that they are not interchangeable and will avoid any confusion in hooking up the tape recorders and bugs.

It has been found that a game board having five tape recorders and bugs, and five string-like elements each of which is approximately sixteen inches in length is eminently satisfactory. The sides of the board, in such event, may be approximately eight to ten inches long. However, the exact size of the strings or of the sides of the boards is not critical, particularly where the detent means 32 on the string is adjustable therealong as would be the case if knots are to be tied. An advantage of a string having a variable effective length, i.e., that length which extends from the opening of the tape recorder on the playing surface of the board, is that by varying the effective length of the string and by varying the location of the "bugs" in different areas the puzzle becomes versatile in affording a variety of puzzles and solutions. In order to accomplish this objective, therefore, the "bugs" might be detachable from the board so as to be located in a number of different areas or movable from one area to another when it is desired to "solve" a different puzzle represented by the new arrangement of "bugs" throughout the game board. It is within the contemplation of the invention, for example, to have several sets of "bugs" and corresponding string elements, the latter being given lengths appropriate for the room locations of that particular set of bugs. The sets can be color coded as can the various tape recorder, string and "bug" arrangements of each set.

Although not shown in the drawings, a cover may be provided to fit over the back of the board to house the strings therein when the game is not in use. Also, an easel stand may be hingedly connected to the back of the board foldable against the undersurface of the board. One extremity of the easel may be shaped so as to form the steps to the Pentagon.

The puzzle or game may be played in accordance with the following rules and instructions, reference to be had to FIG. 1 of the accompanying drawings which illustrates one solution for the puzzle when the "bugs" are located in the room as shown:

The objective of the game or puzzle is to hook up the string-like elements 28 from their respective tape recorders 30 in taping room 27 to the corresponding microphones or "bugs" 38. The following rules must be observed:

1. No two wires (elements 28) can run through the same room, hallway or area.
2. No two wires can cross over each other.
3. One wire may pass through the central pentagonal courtyard.
4. The wire can pass from one area to another only by means of the doorways (openings) in the walls.

The string-like elements 28 can be made of string, wire, chain or the equivalent. It must, of course, be sufficiently flexible such that it can be bent to wind through the doorways of the various rooms and hallways to ultimately reach the microphone.

From the foregoing it will be seen that a puzzle or game is provided which, unlike the customary puzzle, may, if so constructed, afford a variety of challenges and solutions, and as such is capable of maintaining the sustained interest of the players.

I claim:

1. A puzzle comprising:

a game board having a plurality of predesignated areas on the playing surface thereof;

upstanding walls defining the perimetral boundaries of said areas;

at least one opening in the wall defining each of said areas;

a plurality of first connecting means in one of said areas adapted to have a plurality of string-like elements secured adjacent one end thereof respectively to corresponding ones of said connecting means;

a plurality of second connecting means located separately in preselected other of said designated areas adapted to be detachably connected with the other ends of the string-like elements; and a plurality of string-like elements each adapted to be secured adjacent one end thereof to respective ones of said first connecting means and at the other end with respective ones of said second connecting means.

2. A puzzle according to claim 1, wherein said game board is shaped pentagonally.

3. A puzzle according to claim 1, wherein each of said string-like elements at the said other ends thereof is provided with an element cooperable detachably with an element of said second connecting means to detachably connect said string-like element and second connecting means.

4. A puzzle according to claim 1, wherein said game board includes a base member having a hollow portion located beneath said one area of the playing surface.

5. A puzzle according to claim 1, wherein said first and second connecting means and said string-like elements are color coded to identify individual groups of connecting means and string-like elements.

6. A puzzle according to claim 1, wherein each of said string-like elements are adjustable in effective length.

* * * * *